United States Patent [19]

Allmer

[11] 4,096,806

[45] Jun. 27, 1978

[54] TRACK TAMPER WITH HINGEABLE UNITARY PIVOTABLE TAMPING UNIT

[75] Inventor: Franz Allmer, Sophia, N.C.

[73] Assignee: Graystone Corporation, Monroeville, Pa.

[21] Appl. No.: 745,602

[22] Filed: Nov. 29, 1976

Related U.S. Application Data

[63] Continuation-in-part of Ser. No. 632,710, Nov. 17, 1975.

[51] Int. Cl.[2] ..... E01B 27/16

[52] U.S. Cl. ..... 104/12; 104/10

[58] Field of Search ..... 104/7 R, 12, 10

[56] References Cited

U.S. PATENT DOCUMENTS

| | | | |
|---|---|---|---|
| 2,973,719 | 3/1961 | Plasser et al. | 104/12 |
| 3,534,687 | 10/1970 | Plasser et al. | 104/12 |
| 3,625,156 | 12/1971 | Anderson | 104/12 |
| 3,675,581 | 7/1972 | Plasser et al. | 104/12 |
| 3,687,081 | 8/1972 | Plasser et al. | 104/12 |
| 3,885,883 | 5/1975 | Sieke et al. | 104/10 |
| 3,981,247 | 9/1976 | Theurer | 104/12 |

FOREIGN PATENT DOCUMENTS

| | | | |
|---|---|---|---|
| 938,498 | 12/1973 | Canada | 104/12 |

*Primary Examiner*—Drayton E. Hoffman
*Assistant Examiner*—Carl Rowold
*Attorney, Agent, or Firm*—Lane, Aitken, Dunner & Ziems

[57] ABSTRACT

In a track tamping machine, opposed pivotally mounted tamping arms are oscillated by respective single acting hydraulic cylinders controlled by one or more hydraulic duplex rotary distributing valves. Fluid supply and return lines for each piston assembly are connected to a source of pressurized hydraulic fluid by way of a respective rotary valve. Each valve has a stationary ported shell which receives a rotary cylindrical spool having a pair of axially displaced supply and return throughports which alternately register with supply and return line ports in the shell to open and close the connections between the oscillating cylinder and the supply and return lines. Such oscillating cylinders are useful in controlling the vibration of the tamper arms in a track tamper unit. Accordingly, this disclosure particularly relates to a unitary, hinged, pivotable unit, to which such a tamping unit is secured, which hinged unit is readily adapted for conversion of an existing track tamper to incorporate the oscillatory drive features described above. The oscillating cylinder is located adjacent a squeeze cylinder and the cylinder pair is secured to an end of each of the tamping arms and to a support member of the tamping unit. The tamping unit is attached to and vertically movable relative to the hinged unit which in turn is laterally movable relative to a rail when secured to the tamping machine. Thus, the tamping tool is controlled as to its depth of penetration, throw of oscillation, and outward to inward movement. Alternate embodiments and features are also disclosed.

8 Claims, 11 Drawing Figures

TRACK TAMPER WITH HINGEABLE UNITARY PIVOTABLE TAMPING UNIT

CROSS-REFERENCE TO RELATED APPLICATIONS

This application is a continuation-in-part of the applicant's copending application Ser. No. 632,710, filed Nov. 17, 1975, assigned to the assignee of this application and contains subject matter related to pending application Ser. No. 632,696, filed Nov. 17, 1975, of which the applicant is a joint inventor, also assigned to the assignee of this application.

BACKGROUND OF THE INVENTION

This invention relates generally to the field of railroad ballast tampers or track tamping machines and hydraulic systems for producing vibratory motion. More particularly, this invention relates to a hydraulic vibrator system for operating track tamping apparatus. Still more particularly, this invention relates to a track tamping machine incorporating a laterally movable hinged unit to which is attached the vertically movable particular hydraulically controlled oscillatory tamper system in combination with a squeeze cylinder for controlling the squeeze and vibration of a tamping tool, its vertical height, and its lateral mobility for compacting ballast beneath the rail.

Prior art track tamping machines of the type to which the present invention relates are exemplified by the machine illustrated in U.S. Pat. No. 3,135,223 to Plasser et al. In this system a pair of pincer-like tamper arms are pivotally mounted on a specially designed railroad car having suitable hydraulic systems to enable the tamper arms to be driven sharply into the ballast on either side of the end of a railroad tie. The upper ends of the tamper arms are coupled by a yoke to an eccentric shaft. Rotation of the eccentric shaft imparts vibratory motion to the lower ends of the tamper arms thus assisting in consolidating the ballast. The ends of the tamper arms extend downwardly into the ballast below the tie and are gradually squeezed together by hydraulic means during the compacting operation. Hydraulic systems for controlling the distance between the two tamper arms are shown in U.S. Pat. Nos. 3,211,064, 3,146,727, 3,372,651, 3,357,366, 3,608,498, 2,872,878, and 3,669,025, all to Plasser et al and 2,791,971 to Schellmann.

As discussed in U.S. Pat. No. 3,135,223, track tamping is normally done in conjunction with a leveling operation. A rail which is found to be too low is jacked up by hydraulic means carried on the railroad car tamper unit while the ballast is compacted to raise the associated railroad tie ends which support the section of the rail. In all of the above systems, the vibration of the tamper is induced by the eccentric mounting rather than by hydraulic piston apparatus. The disadvantages which attend the use of an eccentric vibratory mechanism include the cost of replacement and maintenance of the eccentric mechanism and the overall complexity of the unit. In addition, the eccentric shaft requires a fly wheel which cannot be started and stopped between tamping operations on adjacent ties. Thus, even while lifting the tamping arms to move them to the next tamping station, the vibratory motion continues, resulting in unnecessary wear, power consumption and noise pollution. In an environment sensitive to noise pollution, it is desirable to conveniently cease operation between tamping cycles, but this is largely impossible with inertia-dominated devices.

Hydraulic position apparatuses have been considered in connection with providing vibratory motion for the tamper arms. In U.S. Pat. No. 2,973,719 to Plaser et al, a double-acting hydraulic piston, gated by a hydraulic rotary distributor valve, has a rack which meshes with a pinion on a shaft to oscillate a pair of displaced jaws on the end of the shaft. The rotary valve causes six reciprocations per revolution by using a complicated double manifold arrangement and chordal throughports in the spool within the rotary valve. U.S. Pat. No. 3,735,708 to Plasser et al illustrates the use of a hydraulic piston motor which an automatic flip-flop valve to vibrate the tamping tool. The background of the U.S. Pat. No. 3,735,708 indicates the general disadvantages of using separate coaxially arranged hydraulic cylinders to vibrate tamping tools.

U.S. Pat. No. 2,022,738 to Krute illustrates a highly complicated hydraulic rotary control valve for operating a pump. The rotary valve gates hydraulic fluid to and from duplex double-acting hydraulic pistons to provide uniform output flow velocity from the pump.

In the applicant's copending application, Ser. No. 632,710, filed Nov. 17, 1975, and in copending application Ser. No. 632,696, filed on the same data and assigned to the assignee of this application, systems incorporating the above-described tamper arms controlled by rotary valves and oscillating cylinders are disclosed and claimed. It is a particular feature of this application to provide an improvement over the disclosures of both the aforementioned copending applications in a number of respects.

In the first instance, the single acting hydraulic piston assemblies or oscillating cylinders are utilized in combination with a squeeze cylinder to control the degree of throw of the tamping arm beneath the rail in a direction parallel to the rail. It is a problem in the track tamping art to collect ballast from spaces intermediate the ties to deposit the ballast beneath the ties preferably in the area beneath the rail for road bed stability. The apparatus according to the invention provides a greater flexibility in adjusting the range of throw of the tamper arms in a direction parallel to a rail by the use of the squeeze cylinder while continuing to incorporate the vibratory features described in the above-mentioned applications.

Moreover, because track tamping machines are expensive units and maintenance and repair can be costly procedures, particularly if the track tamper is out of service for a long period of time, it is an aim of this invention to provide an apparatus which permits each conversion of existing tamping machines and prompt maintenance. To this end, a hingeable unit has been developed which is structurally adapted for ready connection to an existing track tamper with a minimum of connections. The hingeable unit incorporates a mechanism for vertically adjusting the tamping unit relative to the road bed. The tamping unit utilizes the above-described oscillating and squeeze cylinders which provide for oscillatory and squeeze cylinder control of the range of throw of the track tampers parallel to the track. Hydraulic control of the hinged unit also causes lateral motion to the tamping unit either or both inwardly and outwardly from the rail in order to improve the tamping operation. The hinged connection is readily provided in combination with the structural framework of an existing track tamper by a minimum of connections with the net result that motion may be controlled in the vertical, lateral, and horizontal directions.

The lateral motion of the hinged unit permits an area to be tamped which is greater in extent than conventional track tamping machines with laterally fixed tamping tools. Moreover, by locating the pivotal connection at a point spaced on the order of 8 to 10 from the tamping machine frame, a downward arc can be imparted to the tamping tool which has a maximum depth of penetration in the area most closely adjacent the tie in the absence of other vertical adjustment to the unit.

A pair of such hinged units may be used, one located inwardly of the frame of the tamping machine, the other located outwardly therefrom. When each unit is independently controlled, the tamping operation of one set of tamping tools may be suspended temporarily such as when passing through a frog on a switch, while continuing tamping with the other set of tamping tools. Such flexibility significantly enhances the tamping flexibility of the machine.

It is an alternate feature of the invention that a plurality of tamping tools may be used on each tamping unit, for example, in a plurality of opposed pairs of tools.

These and other objects and aims of the foregoing invention will become apparent from the accompanying specification taken in conjunction with the attached drawings.

SUMMARY OF THE INVENTION

Directed to achieving the aforestated objects and overcoming the problems of the prior art, particularly relating to adapting an existing track tamper to a device which incorporates the subject invention, it is a general object of this invention to provide an improved hydraulic vibratory drive unit for a pair of opposed pivotally mounted tamping arms which unit also includes means for controlling the vertical, horizontal, and lateral motion of the tamping arms.

In the preferred embodiment, the hydraulic vibratory drive unit includes a hydraulic system which comprises a pair of respective plunger type single acting hydraulic pistons or oscillating cylinders to reciprocate respectively the ends of a pair of pivotally mounted pincer-type tamper arms. Each single oscillating cylinder has supply and exhaust lines connected to a source of pressurized hydraulic fluid by way of a respective rotary distributing valve assembly which alternately connects the oscillating cylinder with the supply and return lines. The respective rotary valves for a pair of tamper arms are driven in common at the same frequency. Each rotary valve, as described in the aforementioned copending applications, includes a rotating spool having a pair of throughports intersecting the axis of rotation which alternately register with aligned openings formed in the shell within which the spool member rotates.

The oscillating cylinder is connected to a squeeze cylinder at one end of each of the pincer-type tamper arms to control the movement of the working tool at the opposed end of the tamper arm relative to a pivot point. The hydraulically-actuated squeeze cylinder is controlled by a control valve arrangement with the net result that the work tool vibrates under the influence of the oscillating cylinder and moves relatively parallel to the rail during the tamping operation under the influence of the squeeze cylinder. By successively actuating and retracting the squeeze cylinder, successive tamping operations may be accomplished involving the insertion of the tamping tool at a point intermediate the ties, operating the squeeze cylinder to close the opposed tamping arms relative to the ties to accumulate ballast beneath the ties and preferably beneath the attachment of the rail to the ties, while continuously vibrating the working tool on the tamping arm.

A pair of opposed tamper arms are secured to a frame member to provide a tamping unit which is vertically adjustable in a hingeable frame member adapted for attachment to a tamping machine. The frame member includes a plurality of guide rods piercing a like plurality of guide members. The guide members are secured to a face of the tamping unit frame member and a vertically adjustable hydraulically-actuated cylinder is secured to that face of the frame which is actuatable upon demand to vertically raise or lower the described tamping unit as a unit into the ballast beneath the rails and to retract it therefrom.

Each frame is pivotally connected to a hinged structural arrangement to either or both of the interior or exterior of the main frame members of a tamping machine. Means are provided for laterally moving either of the frame members (together with the tamping unit) generally perpendicularly to the rails in order to tamp ballast at points remote from the rail.

DETAILED DESCRIPTION OF THE PREFERRED EMBODIMENTS

Since the present invention is concerned neither with the mobile carriage of the track tamper nor with the means for positioning the track tamper in relation to the end of a railroad tie, these elements have not been fully illustrated in this description of the preferred enbodiments since any conventional track tamping structure can be used for these purposes in connection with the vibratory drive apparatus of the invention in construction a fully operable track tamper. To the extent that the frame arrangement on such a tamping machine provides a base for securing the hinged unit thereto, such portion has been shown in illustrative detail. However, the precise details of the attachment of the hinged unit to the tamping machine may vary among various machines to suit the requirements at hand. Moreover, the details of the rotary valves and the accompanying vibratory drive mechanism are disclosed in copending parent application Ser. No. 632,710, which disclosure is herein incorporated by reference.

Figure 1:
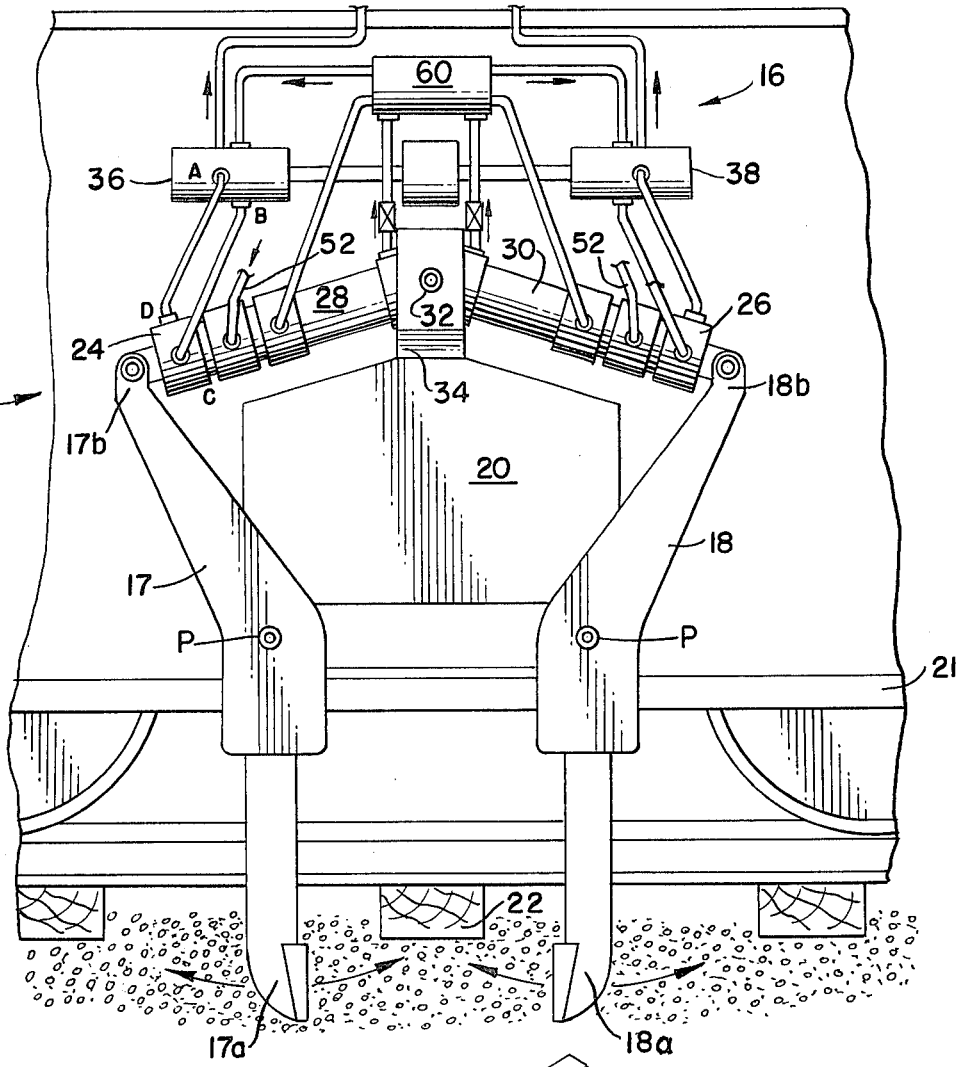
FIG. 1 illustrates a pair of opposed tamper arms pivotally mounted on a support assembly wherein an end of the tamping arm is oscillated under the influence of an oscillating cylinder and squeezed under the influence of a squeeze cylinder mounted adjacent the oscillating cylinder, together with the hydraulics for operating the unit in the vibratory and squeeze modes.

FIG. 1 illustrates a tamping unit, designated generally by the reference numeral 15, in combination with a hydraulic power unit designated generally by the reference numeral 16. The tamping unit 15 includes a pair of opposed tamper arms 17 and 18, each pivotally mounted at points P on a support member 20 carried on a specially designed railroad car 21 operable as a temping machine. The lower ends 17*a* and 18*a* of the tamper arms 17 and 18 each carry one or more tamping tools for compacting the ballast beneath a given railroad tie 22. The upper ends 17*b* and 18*b* of the tamper arms 17 and 18 are each respectively pivotally connected to identical plunger-type, double-acting, hydraulic oscillating cylinders 24 and 26 operatively connected between the upper ends 17*b* and 18*b* of the respective tamper arms 17 and 18 and adjacent squeeze cylinders 28 and 30. The opposite ends of the squeeze cylinders 28 and 30 respectively are connected to a pin 32 mounted between the bifurcated arms of a top support member 34 rigidly secured to the support member 20. The combination of the support member 20, the tamper arms 17 and 18, the oscillating cylinders 24 and 26, the squeeze cylinders 28 and 30, and the upper support member 34 as previously described will hereinafter be referred to as a tamping unit (numeral 15) since such unit is structurally adapted for ready connection to a hingeable frame member which in turn may be secured to the track tamper 16 as will hereinafter be described in connection with FIGS. 5–8.

The operation of the oscillating cylinders 24 and 26 is similar to that described in the applicant's copending application, Ser. No. 632,710. As indicated, each of the oscillating cylinders 24 and 26 is respectively operatively connected to a rotary valve 36 and 38, as described in that application. Specifically, the oscillating cylinder 24, like the oscillating cylinder 26, is operated by pressurized fluid (typically oil) in the interior thereof acting on a piston against the bias force of a compression spring, an equivalent compliant element, or by a pressurized hydraulic system as described in greater detail in connection with FIG. 3. When the interior of the oscillating member receives pressurized fluid, the piston therein is driven leftwardly, carrying with it the output shaft which is pivotally connected to the end 17*b* of the tamper arm 17. The hydraulic fluid is supplied to and exhausted from the interior chamber of the oscillating cylinder by means of a fluid supply line connected through an open port at the rear of the chamber and the fluid return line 54 connected through an open port in the side of the chamber.

Figure 3:
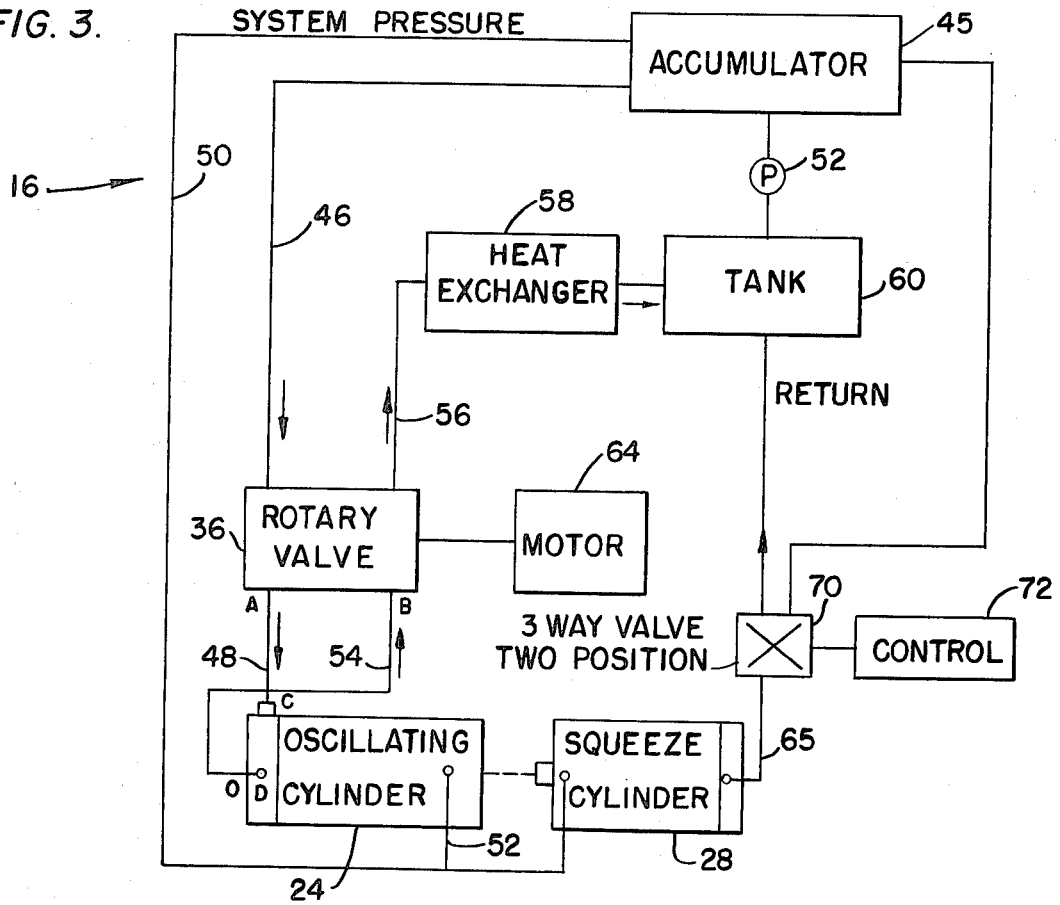
FIG. 3 is a block diagram of the components of the unit and the hydraulic control therefor.

A significant feature of the foregoing arrangement, as will be better understood from the discussion of FIG. 3, is that the fluid system pressure is applied to the rotary valves 36 and 38 at the end opposite to the seal thus minimizing the chance of seal rupture under pressure. The lower system pressure is thus applied to the seal end of the rotary valves 36 and 38.

Figure 2:
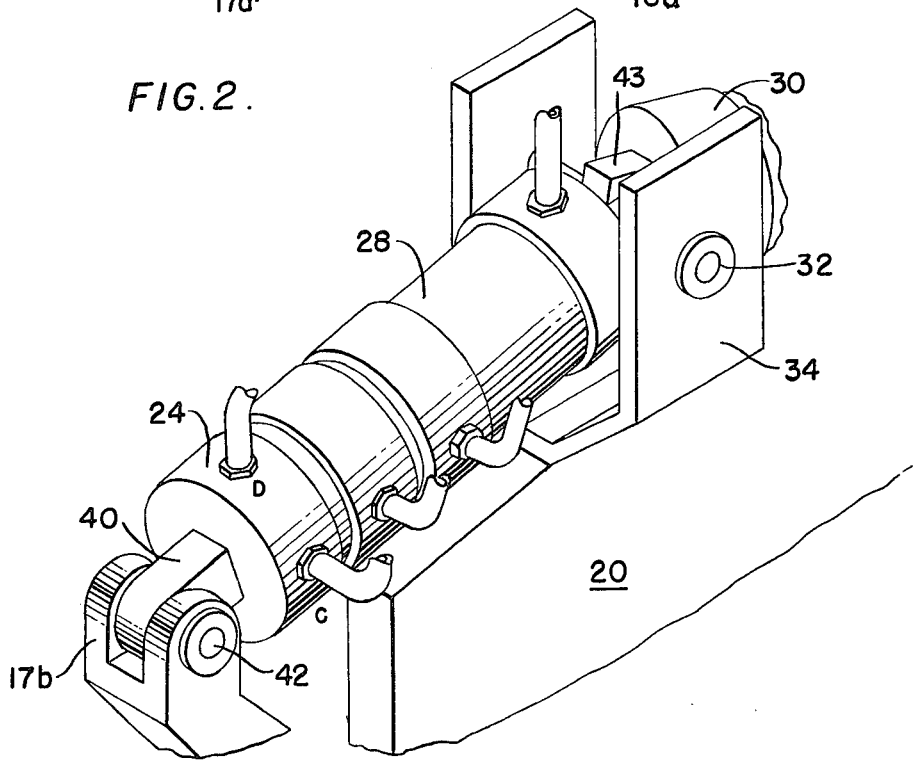
FIG. 2 is an isometric view of the rotary valve of FIG. 1 in combination with the squeeze cylinder.

FIG. 2 is a view in greater detail of the connections of the oscillating cylinder 24 to the squeeze cylinder 28. The upper end 17*b* of the tamper arm 17 is bifurcated to engage the rod end 40 of the squeeze cylinder 24 by a pin 42 therein. The opposite node end of the oscillating cylinder (not shown in detail) is secured to the node end of the squeeze cylinder 28 which in turn has its clevis end 43 secured by the pin 32 between the bifurcated arms of the top support member 34.

As shown in FIG. 3, a system source or accumulator 45 of hydraulic fluid provides fluid through a hydraulic line 46 to the rotary valve 36. The fluid exits through port A through hydraulic line 48 to port C of the oscillating cylinder 24. The system pressure from the accumulator 45 is also provided on line 50 to the opposite end of the oscillating cylinder 24 by line 52. Hydraulic fluid is returned to port B of the rotary valve 36 through an exit hydraulic line 54 and via a hydraulic lead 56 to a heat exchanger 58 to either cool (or if necessary heat) the fluid. The hydraulic fluid flows to the tank 60 from the heat exchanger 58 for return to the accumulator 45 through a pressure check valve 52. As described in the copending application, the rotary valve is driven by a motor 64, and the details of the operation of the rotary valve are described therein.

Similarly, the system pressure on line 50 is provided to the squeeze cylinder 28 having an outlet hydraulic lead 65 connected to a three-way, two-position control valve 70 operable by a control member 72, such as a manual level in the cab, for return to the accumulator 45. In operation, the rotary valve operates as described in connection with the copending application to provide an oscillation at one end of the oscillating cylinder which has system pressure at the other end thereof. Additional components within the system may be necessary or desirable, such as pressure regulation or safety releases with by-pass lines between the outlet of the pump and the accumulator or other portions of the system, but such components are conventional parts of known hydraulic systems used in a wide variety of widely varying applications.

In addition, while two rotary valves are shown, a single rotary valve could be utilized to impart vibrations to both oscillating cylinders by utilizing appropriate hydraulic connections and tee connections. Moreover, only one half of the hydraulic system for FIG. 1 has been described, the other half being indentical to operate like components.

Figure 4:
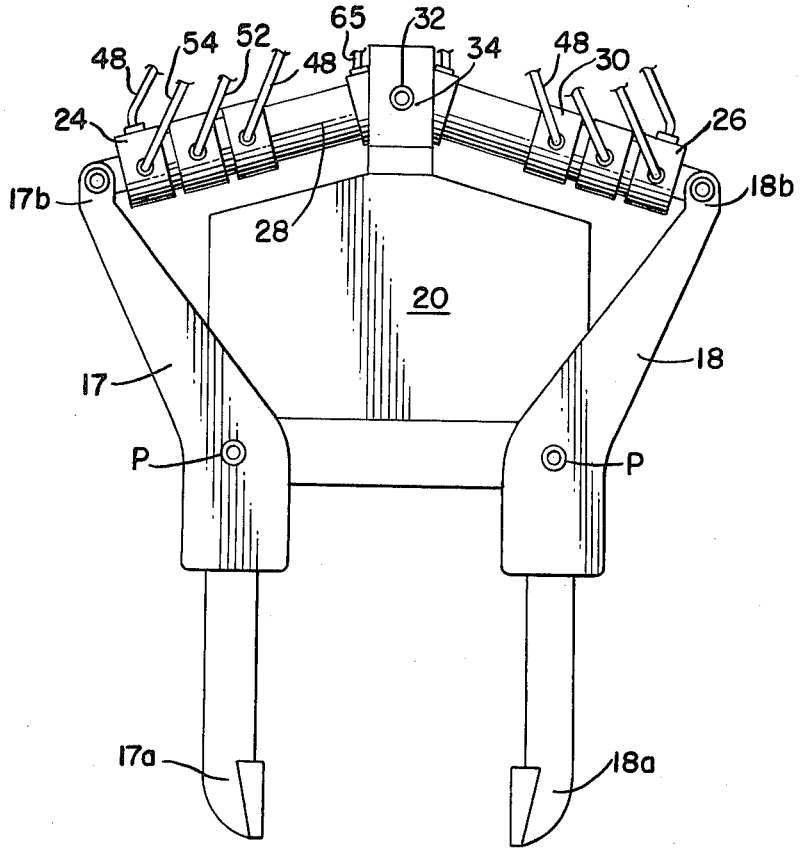
FIG. 4 is a front view of a tamping unit according to the invention structurally adapted for attachment to the hinged unit of the invention.

FIG. 4 illustrates the tamping unit 15 according to the invention, as previously described in connection with FIG. 1. The unit comprises the pair of opposed tamping arms 17 and 18, the oscillating cylinders 24 and 26 respectively, adjacent the squeeze cylinders 28 and 30, the support member 20, and the top support member 34, combined as a dispatchable unit. The unit 15 includes structural connections on a face of the support member 20 for ready connection to a hingeable unit described in connection with FIG. 5 which is attached to the frame of a tamping machine. Specifically, a face of the support member 20 of the tamping unit is provided with a plurality of connections, two of which engage guide members traversing guide rods to impart stability to the tamping unit during vertical ascent and descent under the control of a hydraulic cylinder independently secured to the face of the support member. Such a connection provides a ready and convenient means for controlling the vertical ascent and descent of the tamping unit in addition to the squeeze motion previously described. Since the hingeable unit as described in FIGS. 5-8 is pivotally or hingedly connected to the frame of the tamping machine with additional connections for imparting movement generally perpendicularly to a rail, three degrees of motional freedom are available with the construction as described. The three degrees of freedom may be best understood with reference to FIGS. 9-11.

It may be noted at the outset that the hingeable unit with the tamping unit 15 attached thereto is preferably secured to both the inner and outer sides of a frame of the track tamping machine so that the ballast on both sides of the rail may be tamped simultaneously. Such split head tampers have numerous advantages as will be described in connection with tamping the inner side of the rail independently of the outer side of the rail for convenience in passing through switches, frogs, curvatures in the rails, and the like. Moreover, the independent unitary aspects of the invention provide a number of significant advantages with respect to maintenance and convenience of repair. Specifically, a tamping unit may be relatively easily replaced on a hingeable unit by simply removing the hydraulic connections and disconnecting the tamping unit from the hingeable unit. The hingeable unit itself may be readily removed, if necessary, from the hinged connections to the frame of the tamping machine. Moreover, the hingeable unit is capable of easily converting existing tamping machines to the use of the units as described. The addition of support frame members and hydraulic modifications within the skill of the art may be required once pre-existing tamping control units are removed, thus baring the frame on a tamping machine.

Figure 5:
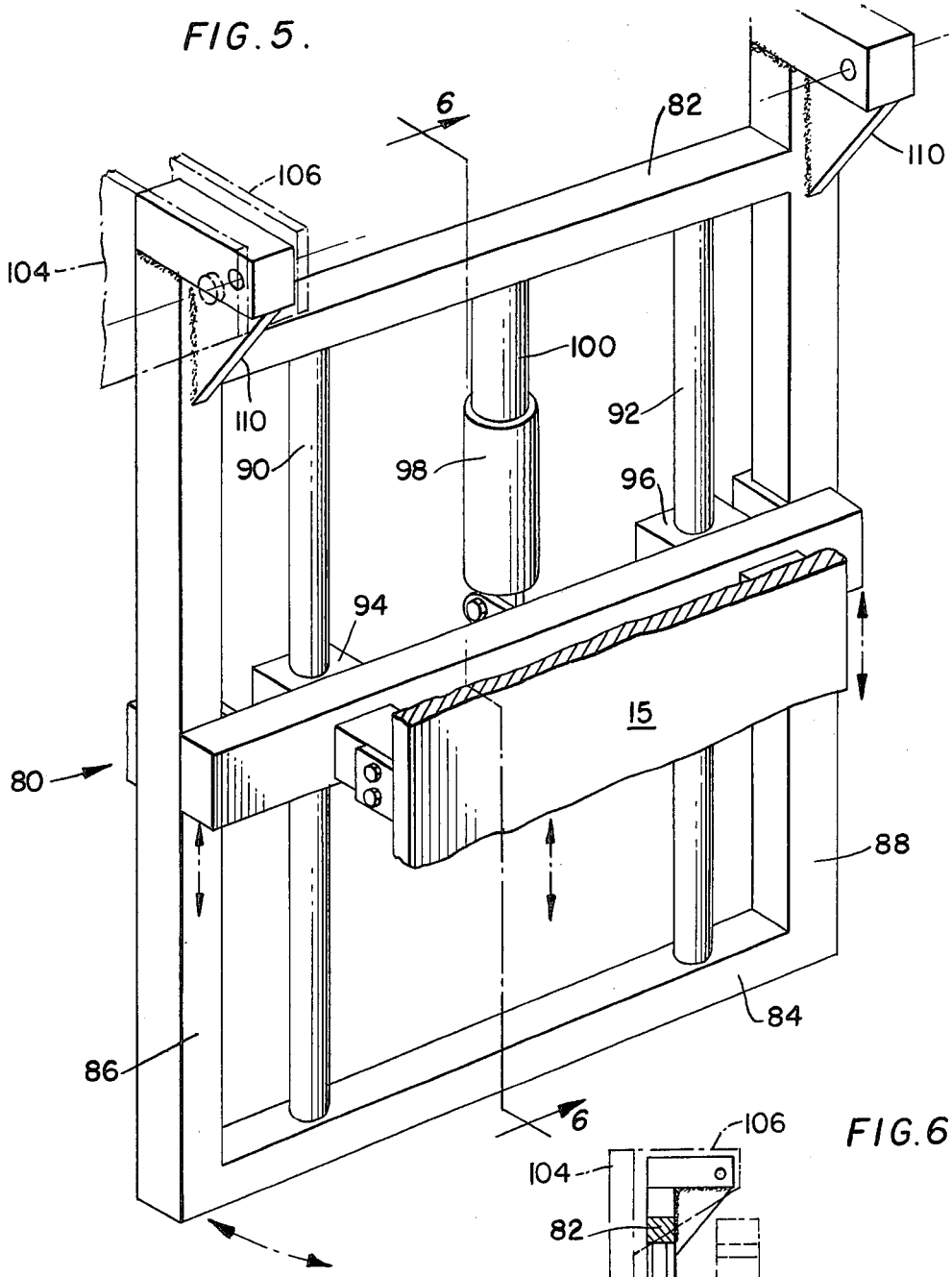
FIG. 5 is a perspective view of the hinged unit according to the invention to which the tamper unit of FIG. 4 is attached.

FIG. 5 shows the tamping unit or the portion thereof connected to a hingeable unit designated generally by the reference numeral 80 which comprises upper and lower frame members 82 and 84 rigidly secured by side frame members 86 and 88 respectively. A pair of guide rods 90 and 92 is secured between the upper and lower frame members 82 and 84 respectively. A pair of guide holders 94 and 96, adapted to vertically traverse the guide rod, as shown in partial detail in FIG. 5 is provided with connections for securing it to the inner face of the support member 20 on the tamping unit 15. Such guide holders have an opening therein for engaging the guide rod therein, with additional means for lubrication to provide an easy traverse of the guide rod while imparting stability to the tamping unit 15 during vertical movement. A cylinder 98, having a position 100 secured to the upper frame member 82, has its clevis end secured to the inner surface of the tamping unit. While the hydraulic connections are not shown in detail, the operation of such pistons is well known in the art, as are controls for such cylinders. When the cylinder 98 is actuated in cooperation with the hydraulic unit on the tamping machines, the tamping unit is caused to raise or lower vertically relative to the ground. Such action permits control of the depth of penetration of the tamping tools on the tamping unit into the ballast as well as permitting removal of the tamping tools from the ballast to permit movement of the tamping machine along the rails to tamp between repetitively-located but adjacent ties.

Figure 6:
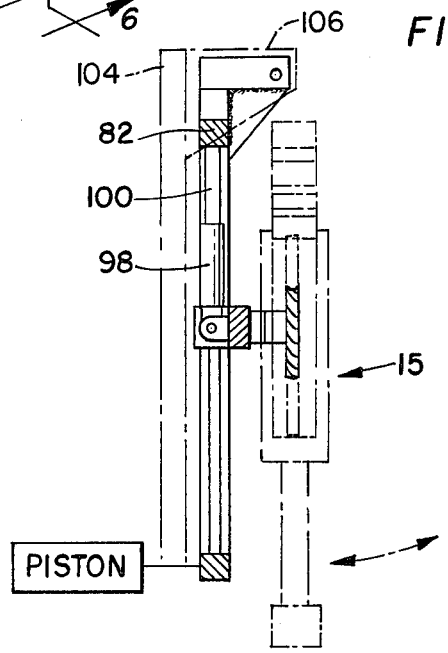
FIG. 6 is a partial side elevational view of the hinged unit secured to a track tamping machine.

FIG. 6 shows a side view in partial detail illustrating a connection of the unit frame to the vertical control cylinder 98. It may be understood that particular details of the connection are within the skill of the art.

Figure 7:
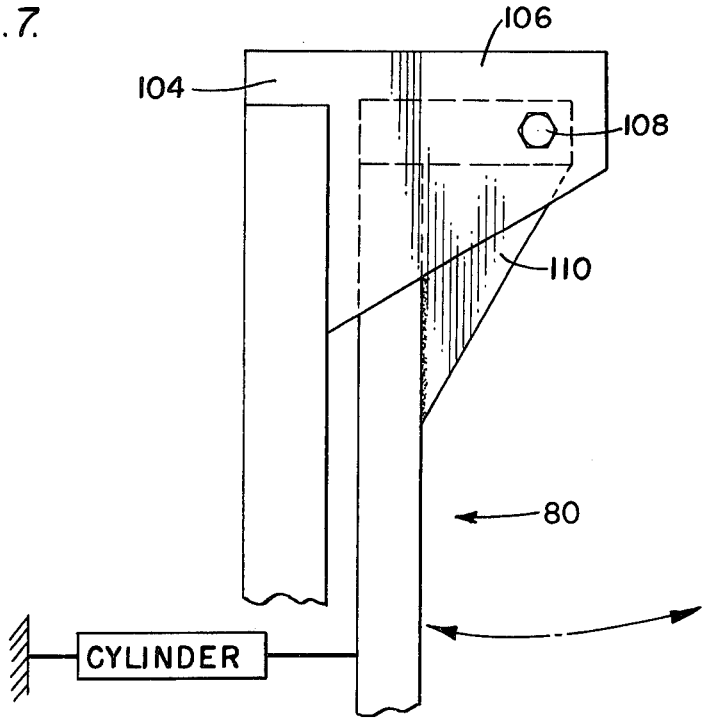
FIG. 7 is a side view showing the hinge detail wherein the pivot point of the hinged unit is spaced from the frame of the tamping machine and diagrammatically showing a cylinder for controlling the lateral movement of the hinged unit.
Figure 8:
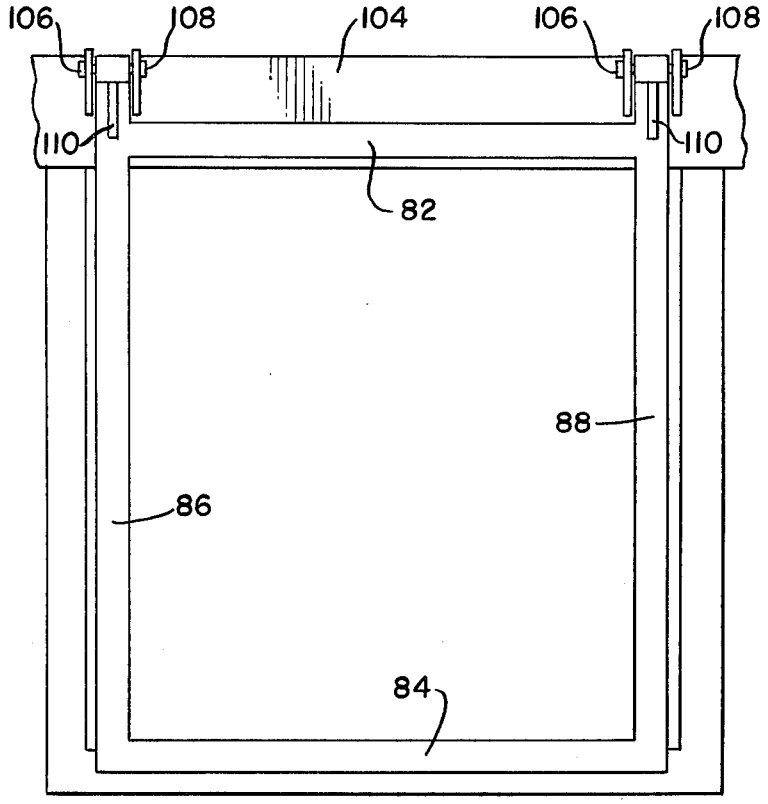
FIG. 8 is a plan view of the hinged unit taken from the side opposite to the tamping unit.

FIG. 7 shows a portion of the frame 104 on the tamping machine to which is secured a plurality of cantilevered support members 106 which are preferably bifurcated to receive a pivot pin 108 therein. By securing an inwardly extending portion of the hingeable unit 80, preferably secured to the upper frame member 104 at positions in register with the respective hinges 110, the unit moves through a downward arc during tamping. The preferably maximum lateral displacement of the pivot point is on the order of 8 to 10 inches to permit the tamping tools on the tamping unit to operate at some predetermined depth somewhat removed from the area immediately adjacent the rail. By controlling the lateral movement of the hingeable unit, the vertical ascent of the tamping unit and the squeeze of the opposed tamping tools, a significantly larger area about the area of connection between a rail and a tie can be tamped, which feature is advantageous in road bed maintenance.

Figure 10:
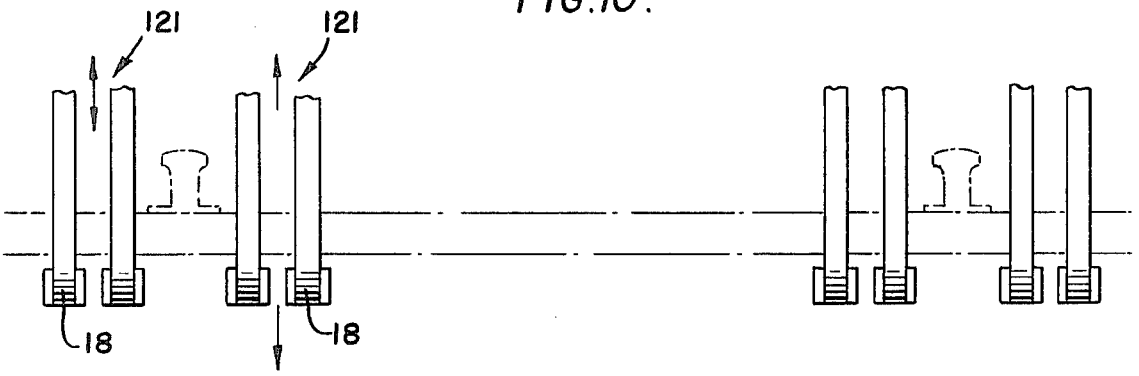
FIG. 10 is a side cross-sectional view of the tamping tools in normal operation relative to a rail.
Figure 11:
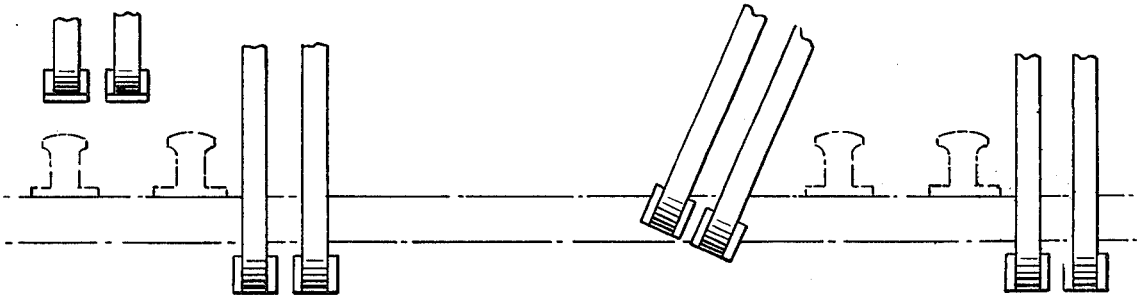
FIG. 11 is a side cross-sectional view of the tamping tools on one side of a rail raised while passing through a frog in a switch.

Because a pair of hingeable units are preferably used, one on the inside and the other on the outside of the frame of the tamping machine, and because each unit is individually actuatable, the operator has a number of significant options in the control of the tamping operation. Moreover, each of the interior and exterior units is independently operable which permits flexibility of operation as shown in FIGS. 9 through 11.

Those figures illustrate the face that a plurality of tamping tools, collectively designated by the reference numerals 120 and 121, may be disposed at the ends of the tamping unit shown in FIGS. 1 and 5. Preferably, all of the tools on the exterior of the rail move upwardly or downwardly as a unit, as do all of the tools on the interior of the rail. Thus, in normal tamping, shown in FIG. 10, both the interior and the exterior of the rail are tamped simultaneously. FIG. 11 illustrates a situation in which a set of tamping tools may be vertically raised when passing through a switch or a frog, thus illustrating a significant feature of the invention.

Figure 9:
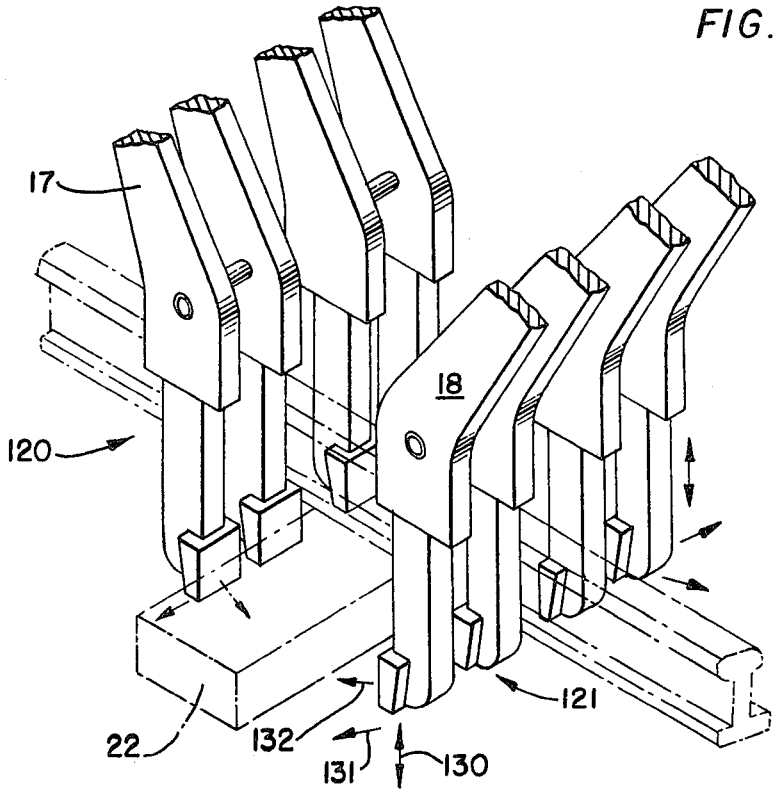
FIG. 9 is a perspective view of a plurality of tamping tools on each tamping unit wherein the tools outwardly located from the rail are operable independently of those inwardly located from the rail.

The arrows 130, 131 and 132 in FIG. 9 show the three degrees of motion of a tamping tool of the apparatus according to the invention. Thus, vertical motion is shown by the arrows 130, lateral motion by the arrows 131, and a squeezing motion by arrows 132. The vertical movement is controlled by the actuation of the cylinder 98, as described in connection with FIG. 5, the lateral motion is controlled by the control of the arc on the hingeable unit as described in FIGS. 7 and 8, while the squeezing motion is controlled by the squeeze cylinder 28 and/or 30 as described in connection with FIG. 1.

The invention may be embodied in other specific forms without departing from its spirit or essential characteristics. The present embodiments are, therefore, to be considered in all respects as illustrative and not restrictive, the scope of the invention being indicated by the claims rather than by the foregoing description, and all changes which come within the meaning and range of the equivalents of the claims are therefore intended to be embraced therein.

What is claimed is:

1. A track tamping apparatus of the type comprising a pair of opposed, vibrating tamper arms pivotally mounted on a tamping frame member supported on a carriage, means for positioning corresponding lower ends of the tamper arms on either side of a railroad tie, and means for drawing the vibrating arms together to compact the ballast thereunder, wherein the improvement comprises:

a pair of oscillating cylinders operatively connected between the drawing means and the upper ends of said tamper arms, respectively, such that reciprocation of each oscillating cylinder causes vibration of the respective tamper arms to aid in compacting the ballast, said drawing means being respectively connected to said tamping frame member, each of said oscillating cylinders having a supply line and a return line for filling and evacuating hydraulic fluid from said oscillating cylinder, respectively, said tamper arms, said drawing means, and said oscillating cylinders being operatively connected to said tamping frame member to define a unitary tamping unit;

a frame assembly hingedly connected to said carriage, said frame assembly including vertically adjustable means for securing said tamping unit thereto so that said tamping unit is vertically movable relative to said frame assembly;

a pair of rotary valve means connected respectively to said oscillating cylinders for alternately communicating said supply and return lines for said respective oscillating cylinders with a common source of pressurized hydraulic fluids; and drive means for imparting continuous rotation to each said rotary valve means.

2. The track tamping apparatus of claim 1, further including means for laterally moving said frame assembly relative to said carriage about said hinge connection.

3. The apparatus of claim 1, wherein said frame assembly is hingedly connected to said carriage by a hinge member having a pivot point for said frame assembly spacedly removed from said carriage.

4. The apparatus of claim 3, wherein said frame assembly includes a horizontal support member having an extension thereon for securing said hinge member so that said frame assembly traverses an arc relative to said carriage.

5. An apparatus for use with a track tamper having a carriage frame and for securing a tamping unit to said track tamper, said tamping unit comprising a pair of opposed, pivotable arms pivotedly connected to a support member, one end of each of said arms being connected to oscillatory means and drawing means for vibrating said pivotable arms and drawing said pair of arms together, respectively, said apparatus comprising:

rotary valve means connected to said oscillatory means for controlling fluid communication between said oscillatory means and a source of pressurized fluid;

a frame which includes an upper horizontal member, a lower horizontal member, and a pair of spaced vertical members securing said upper and lower horizontal members in a spaced relationship;

vertically movable connecting means for structurally attaching said tamping unit to said frame so that said tamping unit is vertically adjustable relative to said frame;

guide means secured to said frame and to said connecting means for guiding the movement of said connecting means;

lift means secured to said frame and to said connecting means for vertically moving said connecting means between said upper and lower frame members;

a first hinge member secured to said carriage frame of said track tamper which defines a pivot point spaced from said carriage frame; and a second hinge member on said frame for mating with said first hinge member so that said frame is laterally movable relative to said carriage frame.

6. The apparatus of claim 5, further including lateral movement means for selectively imparting lateral motion to said frame.

7. The apparatus of claim 5, further including a plurality of said frames positioned on said carriage frame so that tamping units secured to said frames can work opposite sides of a track rail.

8. The apparatus of claim 7, wherein tamping tools secured to opposed tamping units are individually operable.

* * * * *